US008689713B2

(12) United States Patent
Suojanen et al.

(10) Patent No.: US 8,689,713 B2
(45) Date of Patent: Apr. 8, 2014

(54) METHOD FOR IMPROVING THE ICE-BREAKING PROPERTIES OF A WATER CRAFT AND A WATER CRAFT CONSTRUCTED ACCORDING TO THE METHOD

(75) Inventors: Reko-Antti Suojanen, Helsinki (FI); Tom-Christian Mattsson, Helsinki (FI)

(73) Assignee: Aker Arctic Technology Inc., Helsinki (FI)

( * ) Notice: Subject to any disclaimer, the term of this patent is extended or adjusted under 35 U.S.C. 154(b) by 606 days.

(21) Appl. No.: 12/667,678

(22) PCT Filed: Jun. 6, 2008

(86) PCT No.: PCT/FI2008/050335

§ 371 (c)(1),
(2), (4) Date: Jan. 4, 2010

(87) PCT Pub. No.: WO2009/007497

PCT Pub. Date: Jan. 15, 2009

(65) Prior Publication Data

US 2010/0162934 A1 Jul. 1, 2010

(30) Foreign Application Priority Data

Jul. 6, 2007 (FI) ..... 20075521

(51) Int. Cl.
*B63B 35/08* (2006.01)
*B63H 5/08* (2006.01)
*B63H 5/125* (2006.01)

(52) U.S. Cl.
USPC ..... 114/40; 440/53; 440/79

(58) Field of Classification Search
USPC ..... 114/40–42, 144 R, 146; 440/53, 79
See application file for complete search history.

(56) References Cited

U.S. PATENT DOCUMENTS 3,483,838 A * 12/1969 Rath ..... 114/60
5,036,781 A 8/1991 Jarvi (Continued)

FOREIGN PATENT DOCUMENTS

DE 2241840 A1 3/1974
EP 1329379 A1 7/2003

(Continued)

OTHER PUBLICATIONS

Gardel, Antony, International Search Report for PCT/FI2008/050335, Dec. 16, 2008.

(Continued)

*Primary Examiner* — Ajay Vasudeva
(74) *Attorney, Agent, or Firm* — Chernoff, Vilhauer, McClung & Stenzel LLP

(57) ABSTRACT

A watercraft has a hull with a first end and a second end and is equipped at its second end with a propulsion arrangement that includes at least three propulsion devices each provided with a propeller. A majority of the propulsion devices are rudder propeller devices, and the propeller of at least one of the propulsion devices is at a first distance from the second end of the hull and the propeller of at least another one of the propulsion devices is at a second distance, greater than the first distance, from the second end of the hull. In ice conditions the watercraft is operated with the second end ahead, so that at least one propeller at the first distance from the second end of the hull breaks ice and at least one propeller at the second distance from the second end of the hull moves disintegrated ice or ice chunks away from the ice build-up.

14 Claims, 1 Drawing Sheet

(56) References Cited

U.S. PATENT DOCUMENTS

| | | | | |
|---|---|---|---|---|
| 5,218,917 | A * | 6/1993 | Harjula et al. | 114/40 |
| 5,996,520 | A | 12/1999 | Arpiainen et al. | |
| 7,013,820 | B2 * | 3/2006 | Sakamoto et al. | 114/144 R |
| 7,452,253 | B2 * | 11/2008 | Levander et al. | 440/53 |
| 2005/0070179 | A1 | 3/2005 | Sirvio et al. | |
| 2005/0164574 | A1 * | 7/2005 | Levander | 440/79 |

FOREIGN PATENT DOCUMENTS

| | | | |
|---|---|---|---|
| EP | 1472135 | B1 | 11/2005 |
| EP | 1513724 | B1 | 1/2007 |
| FI | 115128 | B | 3/2005 |
| FR | 2902403 | A1 * | 12/2007 |
| GB | 1285428 | A | 8/1972 |
| JP | 9142391 | A | 6/1997 |

OTHER PUBLICATIONS

Office action (with English translation) JP Patent Application No. 2010-514022, issued Sep. 18, 2012, mailed Sep. 21, 2012, 4 pages.

"Mr. Mark's Homepage, Diplomski rad Gospodina MARK-LEDOLOMAC," http://www.fsb.uni,g.hr/ship-design/progdip.htm, Jan. 10, 2012, 5 pages.

Finnish Search Report, FI 20075521, dated Apr. 22, 2008, 1 page.

* cited by examiner

METHOD FOR IMPROVING THE ICE-BREAKING PROPERTIES OF A WATER CRAFT AND A WATER CRAFT CONSTRUCTED ACCORDING TO THE METHOD

CROSS-REFERENCE TO RELATED APPLICATIONS

This is a national stage application filed under 35 USC 371 based on International Application No. PCT/FI2008/050335 filed Jun. 6, 2008 and claims priority under 35 USC 119 of Finnish Patent Application No. 20075521 filed Jul. 6, 2007.

BACKGROUND OF THE INVENTION

The invention relates to a method of providing a watercraft, especially an icebreaker or a cargo ship, tanker or similar transport vessel with improved ice penetration characteristics, which watercraft has a hull with a first end and a second end and which is equipped at said second end with a propulsion arrangement, which provides the main propulsive thrust of the watercraft, while the watercraft moves with either end ahead, and the steering of the watercraft, whereby said second end of the watercraft is shaped and designed so that it, as such, has efficient ice penetration characteristics. The invention also relates to a watercraft.

There is need and use for various kinds of transport vessels, tankers, service vessels etc. that, in addition to open water conditions, also operate in icy waters and nowadays to an increasing degree even in arctic conditions. In practice, in order to travel efficiently, a vessel requires various bow designs that correspond to varying conditions. For this purpose, a concept has been developed, according to which the front end and aft end of the watercraft are optimized for different conditions, respectively. The concept is described e.g. in the patent publication U.S. Pat. No. 5,218,917 and accordingly, the aft end of the watercraft is shaped and designed to break ice more efficiently than the forward end of "the watercraft so that in heavy ice conditions the vessel moves in the aft direction, whereas in open water conditions the vessel moves more efficiently in the normal forward direction. Apart from the design and reinforcement of the aft end of the hull itself it is characteristic of the concept that the main propulsion devices at the aft end of the watercraft comprise two turnable rudder propeller devices, the propellers of which together with the lower part of the aft end, which is shaped suitably oblique, break the ice. In distinction from a stationary propeller device, where the propeller rotates about a shaft fixedly supported by the hull of the vessel, the term rudder propeller device relates in this specification to a propeller that together with its drive shaft may be turned around a separate shaft and which may be used for maneuvering the vessel without any separate rudder means.

When the aim is to apply said concept on larger cargo vessels, such as tankers, the vessel requires also a fairly high propulsion power as such. The rudder propeller devices according to modern technology have, however, their limitations as for the propulsion power, the power outputs in practice being about 20 MW per rudder propeller device. The restrictions of rudder propeller devices with higher power outputs than this comprise e.g. the space required, weight and price.

The publication EP 1472135 discloses a propulsion arrangement, known as such, suitable for large RoRo vessels comprising a stationary propeller device and rudder propeller devices placed on both sides thereof. This solution as such is advantageous in terms of costs and space utilization, when the problem is the space required and providing a sufficiently high propulsion power also for larger vessels. There is no mention whatsoever in the document regarding the suitability of the solution for vessels that, in addition to open water, may also travel in heavy ice conditions.

Thus, vessels that are intended for use in varying conditions and that would be especially suitable also for use in heavy ice conditions, which in this context include, in addition to thick flat ice, especially ice ridges formed of pack-ice and ice build-ups, require a bow that is suitably shaped to apply better in open water conditions, sufficient ice penetration characteristics for hard ice conditions and in addition, a sufficient propulsion power per se. Apart from the ability to break ice efficiently as such in terms of fuel economy, the ice penetration characteristics include in this context also the ability in general to travel in heavy ice conditions, such as in pack-ice and through ice ridges, which in addition to a suitable design of the structure, also requires sufficient rigidity. This is apparent e.g. when steering through ice ridges and pack-ice for disembarking and/or embarking at a base located in arctic conditions.

The above-mentioned problems partially hold true also in case of actual icebreakers, which may need to move in open waters for a long time before having any real icebreaking tasks. Additionally, the bow in icebreakers is designed for optimum operation especially when breaking thick flat ice, and thus ice ridges and ice build-ups are considerably more challenging, when moving forward. Even if a certain ability to break ice, also when the icebreakers move in the aft direction, is required in order to ensure movability and maneuverability for instance when moving and turning in an open channel, the ability of the icebreaker to break ice when moving in the aft direction is generally substantially worse than when travelling in the forward direction.

A purpose of the invention is to provide a solution to the above-mentioned problems and thus to provide a watercraft, which may be an icebreaker or a vessel suitable for transporting various kind of cargo, which watercraft is more suitable than before to be used in the above-mentioned varying operating conditions, especially in heavy ice conditions, for instance when steering through an ice ridge, ice build-up or pack-ice.

SUMMARY OF THE INVENTION

In this specification the terms "first end" and "second end" of the watercraft have been used instead of "front end" and "aft end", respectively, since the latter terms may give space for interpretation, if the watercraft is used and it moves forward in certain operating conditions variably better with either end ahead.

According to the invention, said propulsion arrangement of the watercraft is chosen so as to include at least three propulsion devices, at least the majority of which are rudder propeller devices and arranged at least at two different distances from said second end of the watercraft so that when the watercraft moves in ice or ice build-ups with said second end ahead, the propeller with one or more propulsion devices located near said second end of the watercraft is arranged to break ice and the propeller with one or more propulsion devices located farther away from said second end of the watercraft is arranged to move disintegrated ice or ice chunks away from the ice build-up.

By means of the invention it is possible to improve substantially the ability of both an icebreaker and a watercraft suitable for carrying various kind of cargo to move forward, particularly in hard pack-ice conditions and through ice ridges, with that end ahead, at which the main propulsive thrust of the watercraft is arranged in both directions of motion. Moreover, this end of the watercraft is also applicable for breaking fairly thick flat ice, which is useful in case of cargo transport vessels. The rudder propeller devices located closer to said second end operate efficiently when breaking or disintegrating packed ice masses. Similarly, when the propulsion device further ahead from said second end is used for moving disintegrated and broken ice chunks and ice masses out of the way, it is possible to improve efficiently the travel of both an icebreaker as well as another watercraft especially in pack-ice and ice ridges compared to prior art solutions.

The present solution does not affect the design of the opposite end of the vessel, but it may be made as such better suited for moving forward efficiently in open waters or, in case of an icebreaker, optimized in a conventional way to suit for breaking thick flat ice. Moreover, depending on the actual operating conditions, i.e. the degree of open water steering as compared to moving in icy condition, said opposite end may also in cargo vessels be designed so that it may be used with advantage even for breaking flat ice. Thus at the same time, the arrangement according to the invention may provide both an icebreaker and a watercraft with better qualifications as a whole for breaking both flat ice and pack-ice.

In order to ensure efficient running of the arrangement in icy conditions, the propulsion devices located at different distances from said second end of the watercraft are placed side by side in the lateral direction of the watercraft.

One advantageous way to utilize a chosen propulsion arrangement is to use one or more propellers to break an ice build-up by blowing a water stream thereto, whereby more of the common propulsive thrust of the propulsion devices is still arranged to move the watercraft toward the ice build-up to be broken and to move broken ice away from the ice build-up.

The watercraft's propulsion devices intended for breaking ice are preferably rudder propeller devices. This makes it possible to turn them and thus enables a more efficient operation and travel of the watercraft in heavy ice conditions. The use of rudder propeller devices in the manner according to the invention is not as such dependent on whether they are so-called pushing or pulling rudder propeller devices in the normal operation of the watercraft. What is essential is the position of the propeller of the propulsion device at the moment, when it is used as disclosed in the invention.

In a preferable practical embodiment the propulsion arrangement is chosen so that it comprises turnable rudder propeller devices arranged at a distance from the longitudinal centre line of the hull, on both its sides, and a stationary propeller device arranged between the rudder propeller devices, the distance of the propeller of which stationary propeller device from said second end of the watercraft is clearly larger than that of the propellers of the rudder propeller devices, when the watercraft moves in the ice said second end ahead. Thus, the rudder propeller devices closest to said second end of the watercraft bite firmly on the ice ridge, whereas the stationary propeller device farther away makes it possible to shape said end of the vessel in the midship area so that the ice breaking angles at the aft end may be kept favorably flat for icebreaking. This solution allows the broken ice to pass freely under the watercraft and further on to the channel behind the vessel from impeding the moving of the vessel forward. In addition, the stationary propulsion device provides the vessel with an efficient thrust when it moves in open water free from ice.

Considering the above-mentioned factors, the rudder propeller devices are preferably dimensioned so that they in all correspond at least a half of the total propulsion power of the watercraft.

BRIEF DESCRIPTION OF THE DRAWINGS

In the following, the invention is explained by way of example with reference to the appended schematic drawings, in which.

DETAILED DESCRIPTION

Figure 1:
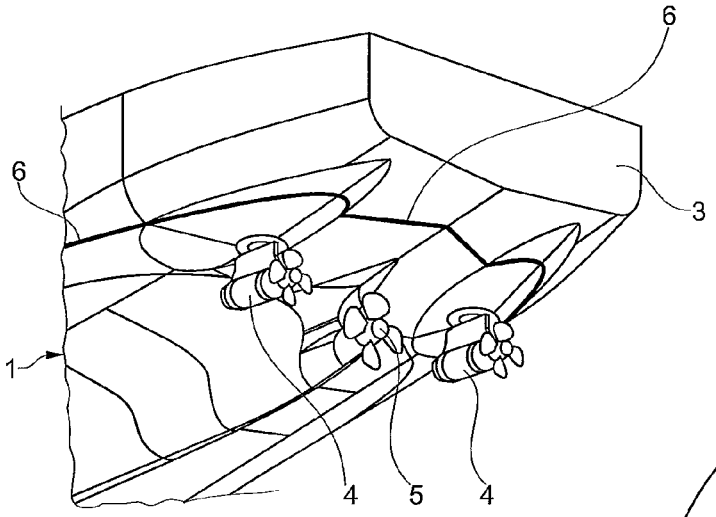
FIG. 1 shows the aft part of a watercraft according to the invention seen obliquely from below.
Figure 2:
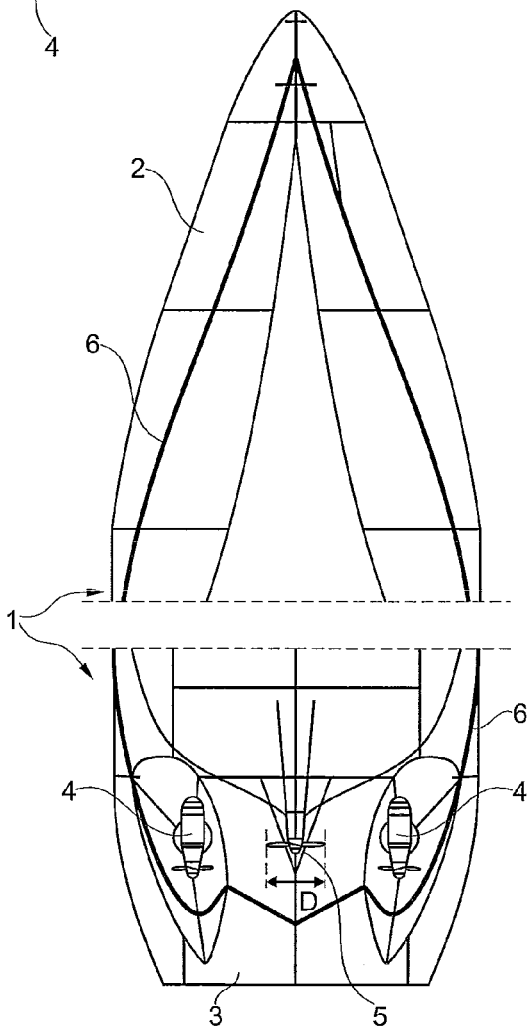
FIG. 2 depicts the watercraft according to FIG. 1 seen from below so that both the front end and aft end are shown.

In the drawings the reference number 1 refers to the hull of the watercraft. For the sake of clarity the first end and the second end of the hull of the watercraft are called here a front end 2 and an aft end 3, respectively. In principle, the watercraft may be any cargo vessel or icebreaker intended to operate both in open water and in ice conditions.

According to the invention, the main propulsion arrangement of the watercraft is placed at the aft end of the watercraft and in this case it comprises two rudder propeller devices 4 and between them a propeller 5 arranged at the end of a stationary shaft. Depending on the type and size of the watercraft it may, in addition to the main propulsion arrangement, also be provided with propulsion devices arranged at the front end, for instance tunnel propellers, if so required, to assist the moving of the watercraft in harbors and other narrow places. Principally however, the watercraft moves both ahead and astern, by means of said main propulsion arrangement according to the invention.

As shown in the figures, the rudder propeller devices 4 are placed in the vicinity of the aft end 3 of the watercraft below a design water line 6. The aft end 3 is in the vicinity of the design water line 6, and somewhat above it, shaped oblique so that it is capable of breaking ice and allowing the movement of the watercraft against the ice so that the rudder propeller devices 4 may bore into the ice with the propeller ahead. Thus, as favorable an arrangement as possible is provided for moving in heavy ice conditions, especially in pack-ice and ice ridges formed thereof. As shown further in the figures, the propellers of the rudder propeller devices 4 are in this case located distinctly closer to the aft end 3 of the watercraft than the propeller of the stationary propeller device 5, which propeller, when the vessel moves with the aft end ahead, guides and takes broken ice chunks under the watercraft and further on to the channel formed behind the vessel and/or partially to the sides, especially if flat ice is concerned.

According to the main principles of the invention, the propulsion arrangement of the aft end 3 of the watercraft comprises propeller devices, in practice most suitably three propeller devices, which are placed at two different distances from the aft end 3 of the watercraft. Accordingly, one or more rudder propeller devices 4 are arranged at the aft end 3 of the watercraft so that said propellers are located closest to the ice and thus participate in the icebreaking. Moreover, the aft end 3 is provided with one or more propeller devices, either rudder propeller devices 4 or stationary propeller devices 5 for removing broken ice chunks efficiently out of the way of the watercraft, which devices are located farther away from the aft end 3 than said propellers of the rudder propeller devices 4, when the vessel travels with the aft end 3 ahead in the ice. This is important, as in heavy ice conditions the broken ice masses already as such disturb essentially the moving of the watercraft in the ice field forward.

The figures show the most favorable embodiment of the invention, which is provided with one stationary propeller device 5 for removing ice chunks. In addition to this operation, said stationary propeller 5 is advantageous, when the aim is to ensure a sufficient propulsion power also when steering ahead in the open water use of the watercraft. Within the scope of the inventive idea, however, even all propeller devices in the propeller arrangement may be rudder propellers 4, and one option may be an arrangement, which comprises only one rudder propeller 4 as the aftmost propeller for breaking the channel, when moving in the aft direction, and two other rudder propellers 4 take care of the removal of ice chunks. The most advantageous propulsion arrangement in each individual case is chosen on the basis of the conditions, in which the watercraft is assumed to be used.

While the aft end 3 of the watercraft is arranged according to the invention so that its ice penetration characteristics are as good as possible especially in pack-ice and similar heavy ice conditions, other features may be taken into better consideration when designing and shaping the front end 2 of the watercraft. An example of this is operating in open water, but also moving forward e.g. in a field of flatter ice, since in practice the most optimum arrangements differ from one another to a certain degree depending on whether the aim is to optimize moving in flat ice or in pack-ice and in conditions with ice ridges efficiently. When the watercraft moves ahead, the rudder propeller devices 4 may preferably be turned half a turn so that they are pulling propellers also in this situation.

The invention is not limited to the shown embodiment, but several variations are conceivable within the scope of the appended claims.

The invention claimed is:

1. A method of providing a watercraft with improved ice penetration characteristics, which watercraft has a hull with a first end and a second end and which is equipped at said second end with a propulsion arrangement which provides both the main propulsive thrust of the watercraft while the watercraft moves with either end ahead and the steering of the watercraft, wherein said second end of the hull is shaped and designed so that it has efficient ice penetration characteristics in that the watercraft has a design waterline and the second end of the hull is oblique in the vicinity of the design waterline and somewhat above it, said propulsion arrangement includes at least three propulsion devices each provided with a propeller, at least a majority of the propulsion devices are rudder propeller devices, and the propeller of at least one of the propulsion devices is at a first distance from the second end of the hull and the propeller of at least another one of the propulsion devices is at a second distance, greater than the first distance, from the second end of the hull, so that that when the watercraft moves in ice or ice build-ups with said second end ahead, at least one propeller at said first distance from said second end of the hull breaks ice and at least one propeller at said second distance from said second end of the hull moves disintegrated ice or ice chunks away from the ice build-up.

2. A method according to claim 1, comprising using at least one of the propulsion devices to blow a water stream towards an ice build-up for breaking the ice build-up.

3. A watercraft with improved ice penetration characteristics, which watercraft has a hull with a first end and a second end and which is equipped at said second end with a propulsion arrangement that provides both the main propulsive thrust of the watercraft while the watercraft moves with either end ahead and the steering of the watercraft, wherein said second end of the hull is shaped and designed so that it has efficient ice penetration characteristics in that the watercraft has a design waterline and the second end of the hull is oblique in the vicinity of the design waterline and somewhat above it, said propulsion arrangement includes at least three propulsion devices each provided with a propeller, at least a majority of the propulsion devices are rudder propeller devices, and the propeller of at least one of the propulsion devices is at a first distance from the second end of the hull and the propeller of at least another one of the propulsion devices is at a second distance, greater than the first distance, from the second end of the hull, so that when the watercraft moves in ice or ice build-ups with said second end ahead, at least one propeller at said first distance from said second end of the hull breaks ice and at least one propeller at said second distance from said second end of the hull moves disintegrated ice or ice chunks away from the ice build-up.

4. A watercraft according to claim 3, wherein the propellers of at least two of the propulsion devices are at said first distance from the second end of the hull.

5. A watercraft according to claim 4, wherein the at least two propulsion devices with a propeller at said first distance from the second end of the hull are rudder propeller devices.

6. A watercraft according to claim 3, wherein two of the propulsion devices are rudder propeller devices each having a propeller at said first distance from the second end of the hull, the two rudder propeller devices being spaced from a longitudinal center line of the hull and at opposite respective sides of the longitudinal center line, and wherein a shaft driven propulsion device having a propeller at said second distance from the second end of the hull is disposed between the rudder propeller devices.

7. A watercraft according to claim 6, wherein the rudder propeller devices in all provide at least a half of the total propulsion power of the watercraft.

8. A method of operating a watercraft, wherein the watercraft has a hull with a first end and a second end and which is equipped at said second end with a propulsion arrangement which provides both the main propulsive thrust of the watercraft while the watercraft moves with either end ahead and the steering of the watercraft, wherein the watercraft has a design waterline and the second end of the hull is oblique in the vicinity of the design waterline and somewhat above it, wherein said propulsion arrangement includes at least three propulsion devices each provided with a propeller, at least a majority of the propulsion devices are rudder propeller devices, and the propeller of at least one of the propulsion devices is at a first distance from the second end of the hull and the propeller of at least another one of the propulsion devices is at a second distance, greater than the first distance, from the second end of the hull, said method comprising operating the watercraft in ice conditions with said second end ahead, so that at least one propeller at said first distance from said second end of the hull breaks ice and at least one propeller at said second distance from said second end of the hull moves disintegrated ice or ice chunks away from the ice build-up.

9. A method according to claim 8, wherein two of the propulsion devices are rudder propeller devices each having a propeller at said first distance from the second end of the hull, the two rudder propeller devices being spaced from a longitudinal center line of the hull and at opposite respective sides of the longitudinal center line, and wherein the method comprises positioning the two rudder propeller devices so the propellers of the two rudder propeller devices bore into the ice as the watercraft moves against the ice.

10. A method according to claim 8, comprising using at least one of the propulsion devices to blow a water stream towards an ice build-up for breaking the ice build-up.

11. A method according to claim 8, wherein the propellers of at least two of the propulsion devices are at said first distance from the second end of the hull.

12. A method according to claim 11, wherein the at least two propulsion devices whose propellers are at said first distance from the second end of the hull are rudder propeller devices.

13. A method according to claim 8, wherein two of the propulsion devices are rudder propeller devices each having a propeller at said first distance from the second end of the hull, the two rudder propeller devices being spaced from a longitudinal center line of the hull and at opposite respective sides of the longitudinal center line, and wherein a shaft driven propulsion device having a propeller at said second distance from the second end of the hull is disposed between the rudder propeller devices.

14. A method according to claim 13, wherein the rudder propeller devices in all provide at least a half of the total propulsion power of the watercraft.

* * * * *